US006632161B1

(12) United States Patent
Nir

(10) Patent No.: US 6,632,161 B1
(45) Date of Patent: Oct. 14, 2003

(54) APPARATUS AND A METHOD FOR LOADING WEIGHTS

(76) Inventor: Daniel Nir, 39 Sharett Street, Ramat Gan 52413 (IL)

( * ) Notice: Subject to any disclaimer, the term of this patent is extended or adjusted under 35 U.S.C. 154(b) by 0 days.

(21) Appl. No.: 09/497,110

(22) Filed: Feb. 3, 2000

(51) Int. Cl.[7] ..... A63B 21/062
(52) U.S. Cl. ..... 482/98; 482/5; 482/901
(58) Field of Search ..... 482/5, 93, 98–103, 482/908

(56) References Cited

U.S. PATENT DOCUMENTS

| | | | | | |
|---|---|---|---|---|---|
| 772,906 | A | * | 10/1904 | Reach | 482/98 |
| 848,272 | A | * | 3/1907 | Thornley | 482/102 |
| 1,053,109 | A | * | 2/1913 | Reach | 482/99 |
| 4,546,971 | A | * | 10/1985 | Raasoch | 482/100 |
| 4,746,113 | A | * | 5/1988 | Kissel | 482/99 |
| 4,986,538 | A | | 1/1991 | Ish, III | |
| 5,037,089 | A | * | 8/1991 | Spagnuolo et al. | 482/5 |
| 5,123,885 | A | * | 6/1992 | Shields | 482/106 |
| 5,306,221 | A | * | 4/1994 | Itaru | 482/98 |
| 5,350,344 | A | * | 9/1994 | Kissel | 482/98 |
| 5,655,997 | A | * | 8/1997 | Greenberg et al. | 482/5 |
| 5,785,632 | A | * | 7/1998 | Greenberg et al. | 482/5 |
| 6,015,367 | A | * | 1/2000 | Scaramucci | 482/5 |
| 6,117,049 | A | * | 9/2000 | Lowe | 482/4 |
| 6,174,265 | B1 | * | 1/2001 | Alessandri | 482/5 |
| 6,224,519 | B1 | * | 5/2001 | Doolittle | 482/5 |

FOREIGN PATENT DOCUMENTS

| | | | | |
|---|---|---|---|---|
| DE | 3332150 A1 | * | 3/1985 | |
| DE | 3724170 A1 | * | 2/1989 | 482/99 |
| EP | 0850667 A2 | * | 5/1998 | 482/98 |
| FR | 2613237 | * | 10/1988 | |

* cited by examiner

*Primary Examiner*—Jerome W. Donnelly
*Assistant Examiner*—Victor Hwang
(74) *Attorney, Agent, or Firm*—Eitan, Pearl, Latzer & Cohen Zedek, LLP.

(57) ABSTRACT

Apparatus and a method for varying the load on an exercise machine is provided. The apparatus includes at least one load-bearing member having a plurality of receivers formed therein, and a plurality of weights in slidable communication with the at least one load-bearing member. Each of the weights has a weight selection device housed therein for selectably locking each of the weights to the receivers of the load-bearing member.

11 Claims, 9 Drawing Sheets

APPARATUS AND A METHOD FOR LOADING WEIGHTS

FIELD OF THE INVENTION

The present invention relates to exercise machines and more particularly to the variable selection of the exercising load on such a machine.

BACKGROUND OF THE INVENTION

There are numerous types of exercising apparatus which provide a user with the opportunity to keep fit by exercising various muscles of the body in opposition to a load. These machines take on various forms, each of which are configured to exercise different muscles in different parts of the body. Some machines combine a number of exercisers in one machine to allow the exercising of different muscle groups. A common feature of such machines is a variable load made up of individual weights the aggregation of any number of which produces the load required by the user.

A typical example of a multiple-exercise machine is described in U.S. Pat. No. 4,986,538 to Ish, which includes a press station at which exercises are performed in opposition to a selected amount of weights. The stack of exercise weights utilized are manually selected by utilizing a pin on the bottommost one of the stack of weights actually used.

SUMMARY OF THE INVENTION

The invention is for exercise machines which utilize a weight stack in order to vary the exercising load. The present invention is designed to allow a user to automatically select a load to exercise against. This may be achieved without rising from his exercising position as the device may be remotely activated. Further, the variable load may be secured to prevent accident when the machine is both in and out of use.

There is thus provided in accordance with a preferred embodiment of the invention an apparatus for varying the load on an exercise machine. The apparatus includes at least one load-bearing member having a plurality of receivers formed therein and a plurality of weights in slidable communication with the at least one load-bearing member. Each of the weights has a weight selection device housed therein for selectably locking each of the weights to the receivers of the load-bearing member.

Furthermore, in accordance with a preferred embodiment of the invention, the apparatus further includes a selector in operative communication with each of the weight selection devices. The selector includes a processor connected to at least one switch device.

Furthermore, in accordance with a preferred embodiment of the invention, the weight selection device includes an operating device in operative communication with a selectable locking device.

In addition, in accordance with a preferred embodiment of the invention, the selectable locking device includes a plate having a configured orifice, the configured orifice slideably or hingeably engages the load bearing member.

Additionally, there is provided, in accordance with a preferred embodiment of the invention, a method for loading weights on an exercise machine, the exercise machine having a plurality of weights in slidable communication with at least one load-bearing member, the method includes the steps of:

determining the exercise weight to be loaded; and communicating the determined weight to be loaded to a selection device housed within each of the weights;

thereby to selectively lock at least one of the weights to the at least one load-bearing member.

Furthermore, in accordance with a preferred embodiment of the invention, the communicating step includes the step of locking at least the lowest weight of the plurality of weights whose aggregate weight is equivalent to the determined weight. Alternatively, the communicating step includes the step of locking each of the plurality of weights whose aggregate weight is equivalent to the determined weight.

Furthermore, in accordance with a preferred embodiment of the invention, the step of locking includes the step of activating a plate having a configured orifice to engage the load bearing member.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
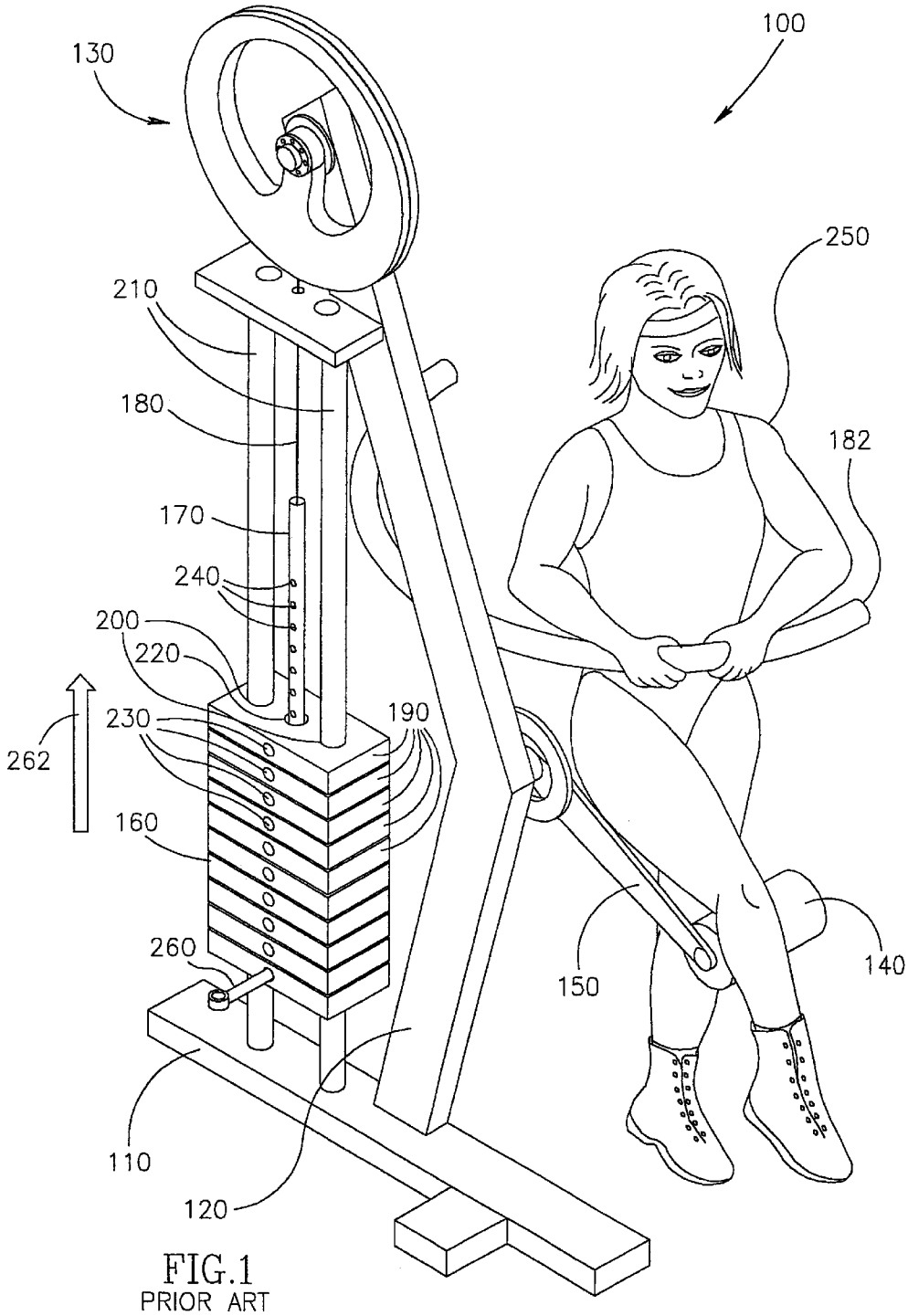
FIG.1 PRIOR ART
FIG. 1 is an isometric illustration of a prior art exercise machine.

Reference is now made to FIG. 1 which is an isometric illustration of a prior art exercise machine generally referenced 100 typically used for exercising the muscles of the lower limbs. Exercise machine 100 generally comprises a base 110 having a column 120 attached thereto. A pulley arrangement, generally designated 130 is suitably attached to the top of column 120. A leg support 140 is connected to a lever arm 150 which is itself pivotally connected to the pulley arrangement 130. A stack of weights 160 is connected via a member 170 and cable 180 and pulley arrangement 130 to operatively provide a counter force to the pivotal movement of leg support 140. Exercise machine 100 further comprises an arm rest 182, connected to column 120, which provides support for a user 250 and a pair of vertical members 210 fixed at one end to base 110.

During exercise, user 250 presses on leg support 140 to force lever arm 150 in a generally downward direction thereby causing the stack of weights 160 to be raised from its rest positions.

Weight stack 160 is made up of individual weights 190, each bored with two holes 200 for 'threading' onto members 210. This arrangement allows each weight 190 to slide up and down members 210. Weights 190 also each have a central hole 220 bored between holes 200 for receiving member 170 into weight stack 160. Additionally, weights 190 each have a bored hole 230 from each of their front faces and coinciding with bored hole 220.

Member 170 comprises a plurality of holes 240 bored through it spaced equally apart to coincide with holes 230 of stack 160. In the normal operating mode of exercise machine 100, each of holes 230 coincides with one of the holes 240 in member 170. A user 250 may then select a weight to exercise against by inserting a peg 260 into one of holes 230 and coinciding with and penetrating through a corresponding hole 240 in member 170 such that when user 250 presses on leg support 140, all the weights 190 above and including the weight into which peg 260 is inserted are lifted. Thus the aggregate of these weights 190 are the load which is utilized for exercise (hereinafter "the Exercise load"). The arrow 262 illustrates the direction of motion of weight stack 160 during exercise.

It should be noted that exercise machine 100, which is utilized to exercise the muscles of the leg, is an example of an exercise machine utilizing the weight loading system described. Other machines 100, exhibiting the same weight loading system would be equally acceptable by way of example. It should also be noted that the principle of operation of weight stack 160 together with member 170 and pin 260 is illustrated by way of example and it should be noted that the precise geometry or arrangement of the components may vary.

Figure 2:
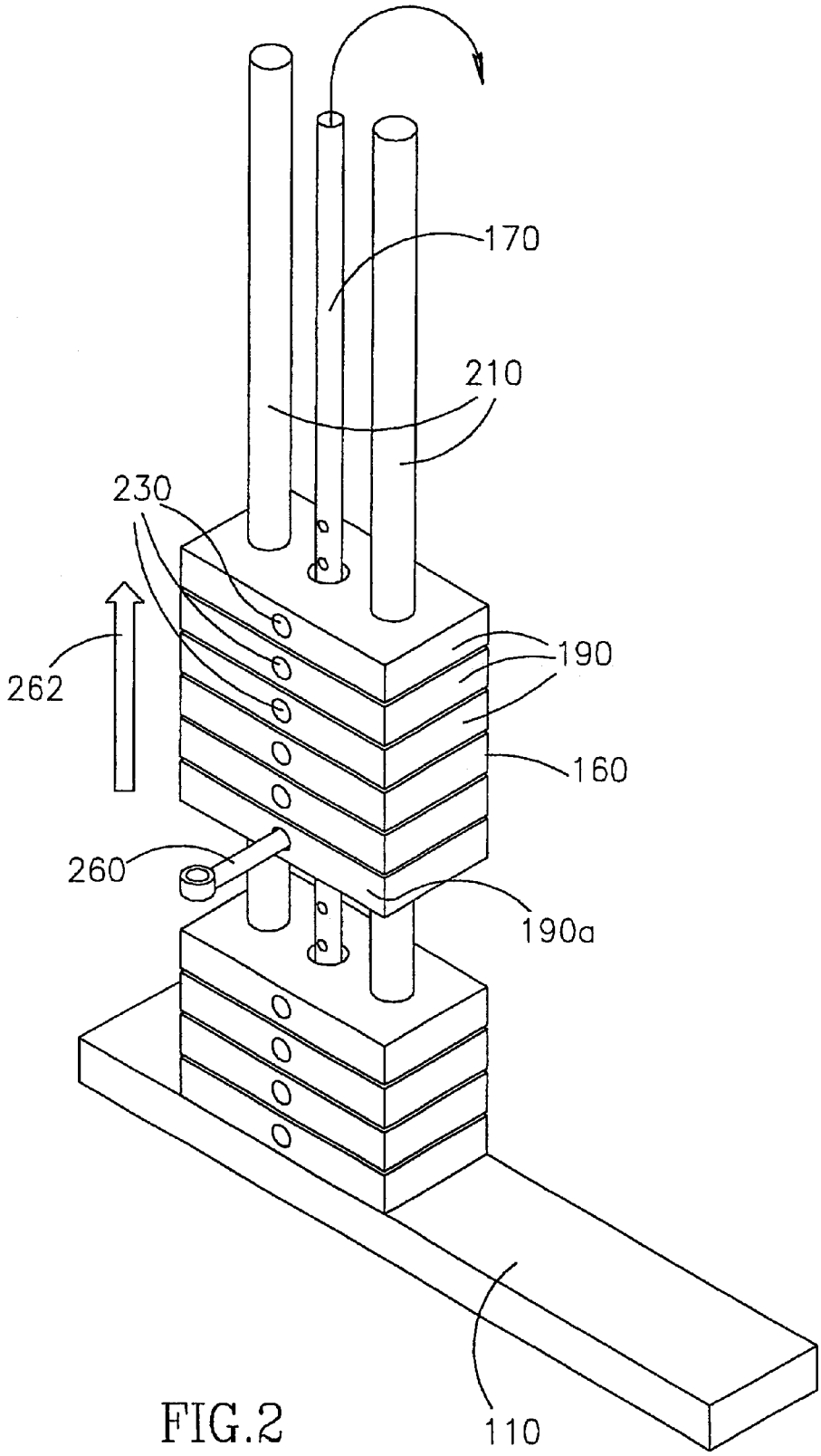
FIG.2 PRIOR ART
FIG. 2 is an isometric illustration of a weight stack for use with an exercise machine, in accordance with the prior art.

Reference is now made to FIG. 2 which is an isometric illustration of a prior art weight stack 160 and its attendant components when the weight of the top six weights 190 is selected as the exercise load. Similar items to those in previous figures have similar reference numbers and will not be described further.

Member 170 is pulled upwards by the action of user 250 (FIG. 1). Peg 260, which is inserted in hole 230 of that weight, causes the weight 190*a* and the weights above it to be pulled upwards by the connection of weight 190*a* to member 170. The pulling action originates at the juncture of peg 260 and member 170 and the weights 190 above weight 190*a* (pulled by peg 260) are pulled upwards by virtue of resting upon weight 190*a* into which peg 260 is inserted. The weights 190 pulled upwards slide along members 210. Thus the exercise load or weight selected is the aggregate of weights 190 above and including weight 190*a* into which peg 260 is inserted.

Figure 3:
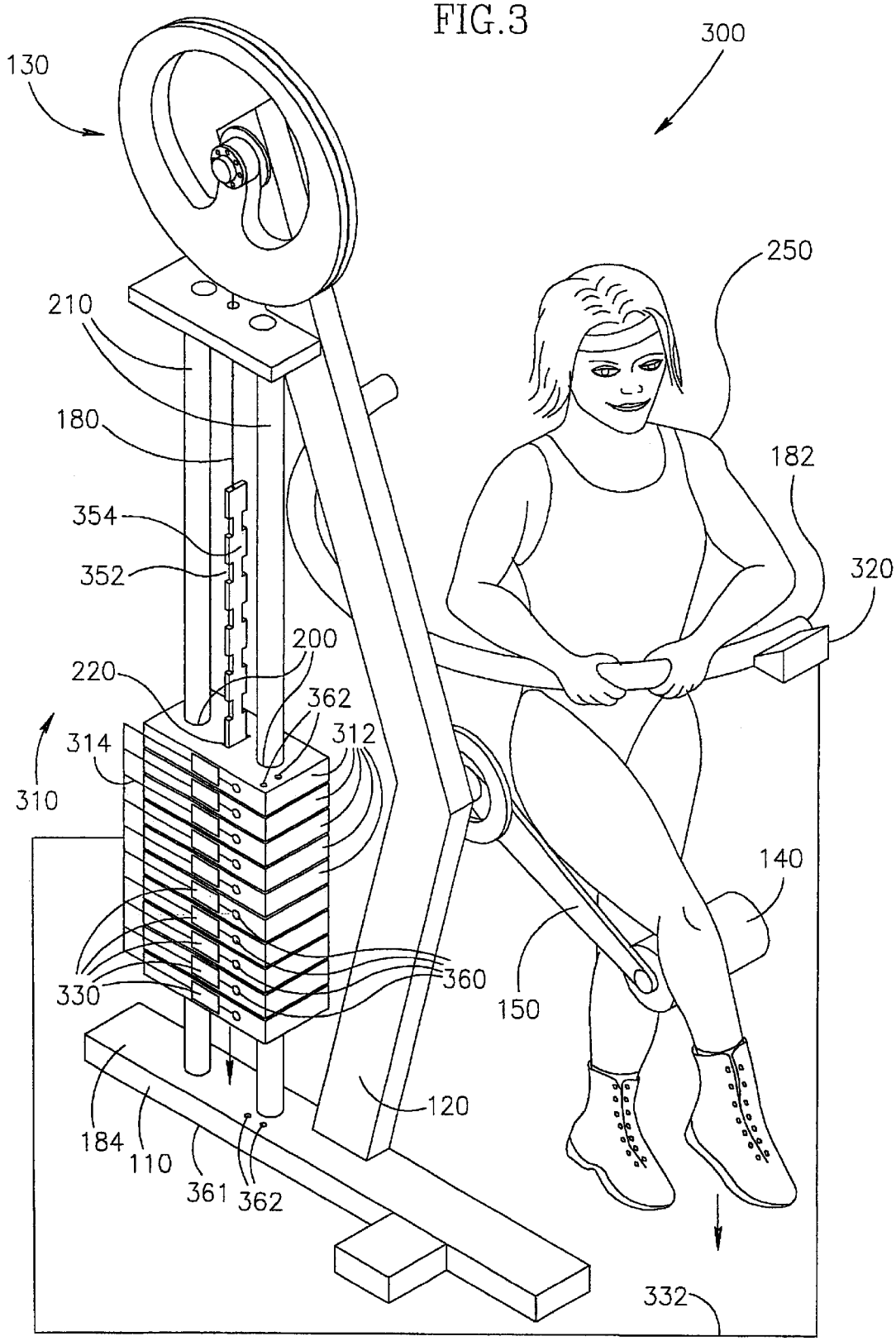
FIG. 3 is a partially schematic, partially isometric illustration of an exercise machine, constructed and operative in accordance with a preferred embodiment of the present invention.

Reference is now made to FIG. 3, which is an isometric illustration of an exercise machine 300, constructed and operative in accordance with the present invention. Similar items to those in previous figures carry similar reference numerals and will not be described further. It should be noted that the invention is not restricted to a particular type of exercise machine, but the present invention is also applicable to other types of exercise machine capable of carrying the selection system.

Exercise machine 300 generally comprises the pulley arrangement 130 and support structure of exercise machine 100, described hereinabove with respect to of FIG. 1. Exercise machine 300 further comprises a vertical threading member 354 which replaces member 170 of FIG. 1 and a weight loading selection system, generally referenced 310.

Weight loading selection system 310 comprises a weight stack 314, composed of a number of weights, referenced 312 and a control device 320 connected to a selection device 330, which is preferably contained within each weight 312.

Control device 320, which is preferably attached to handle 182, is connected to selection device 330 via a wire or wireless link 332. For exemplary purposes only, a wired link is shown in FIG. 3.

Figure 4:
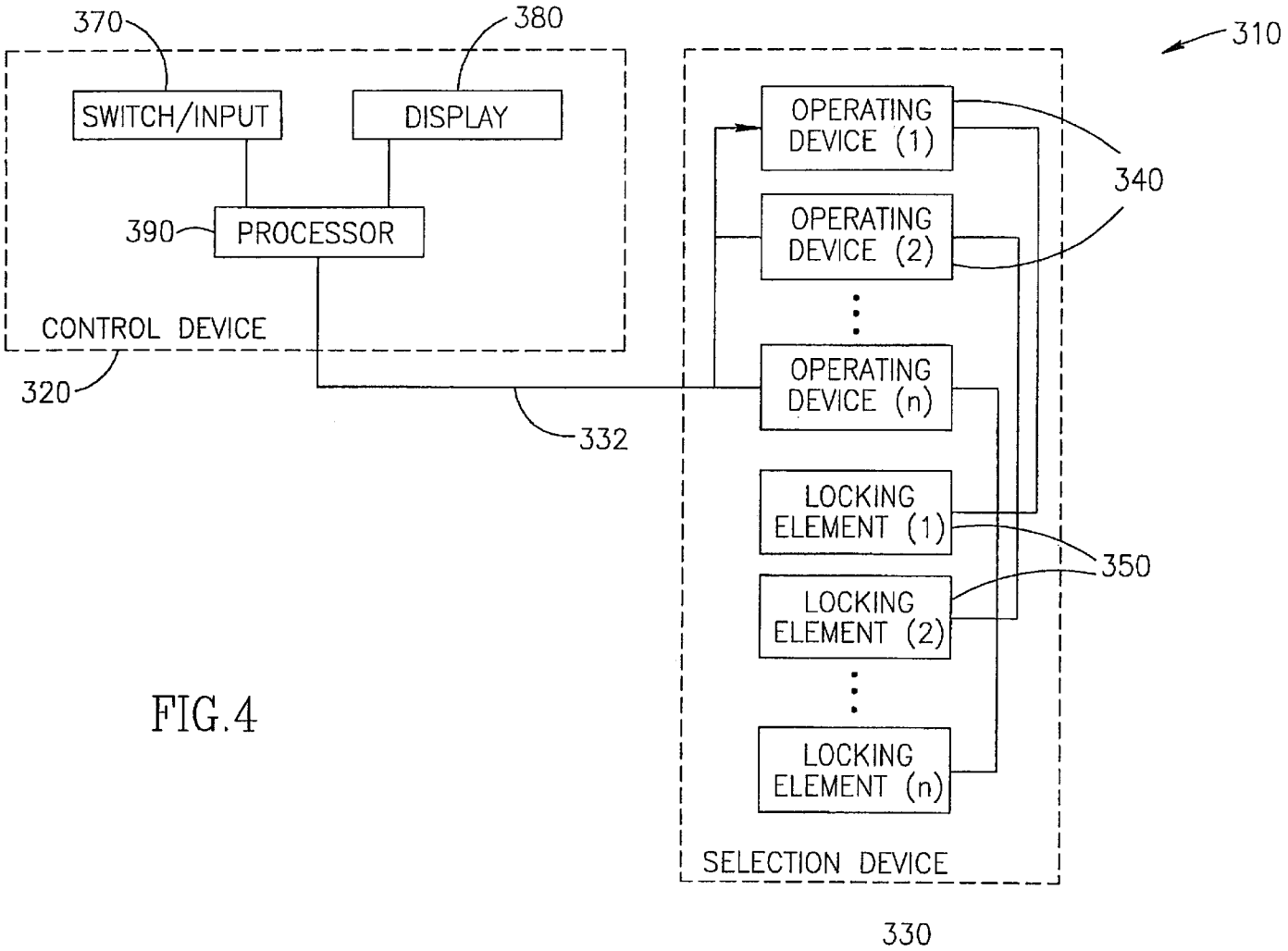
FIG. 4 is a schematic block diagram illustration of the components of the weight selection apparatus of the exercise machine, of FIG. 3.
Figure 5A:
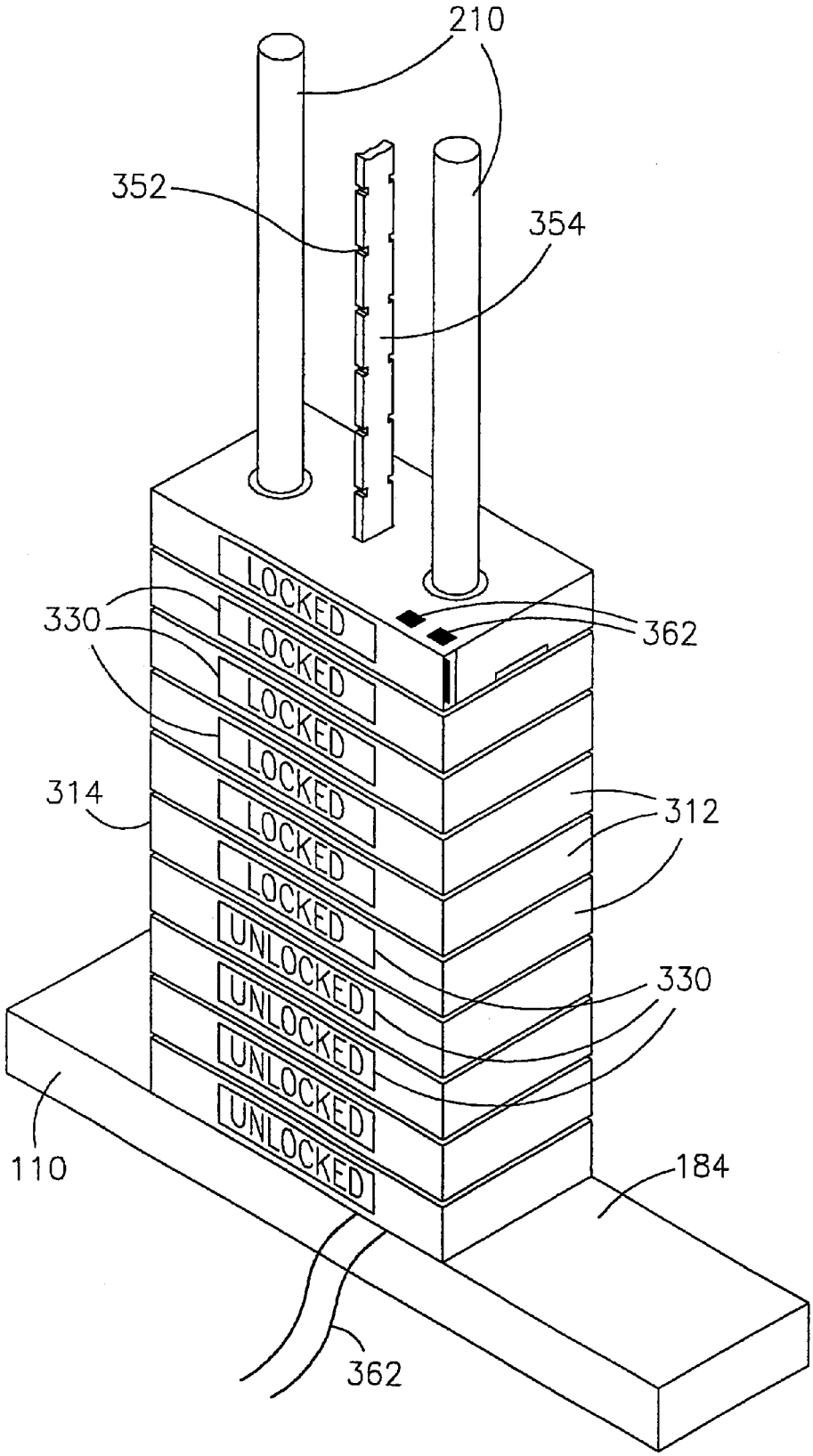
FIGS. 5A–5B are schematic illustrations of the load varying system in a static non-used mode and exercise mode, respectively.
Figure 5B:
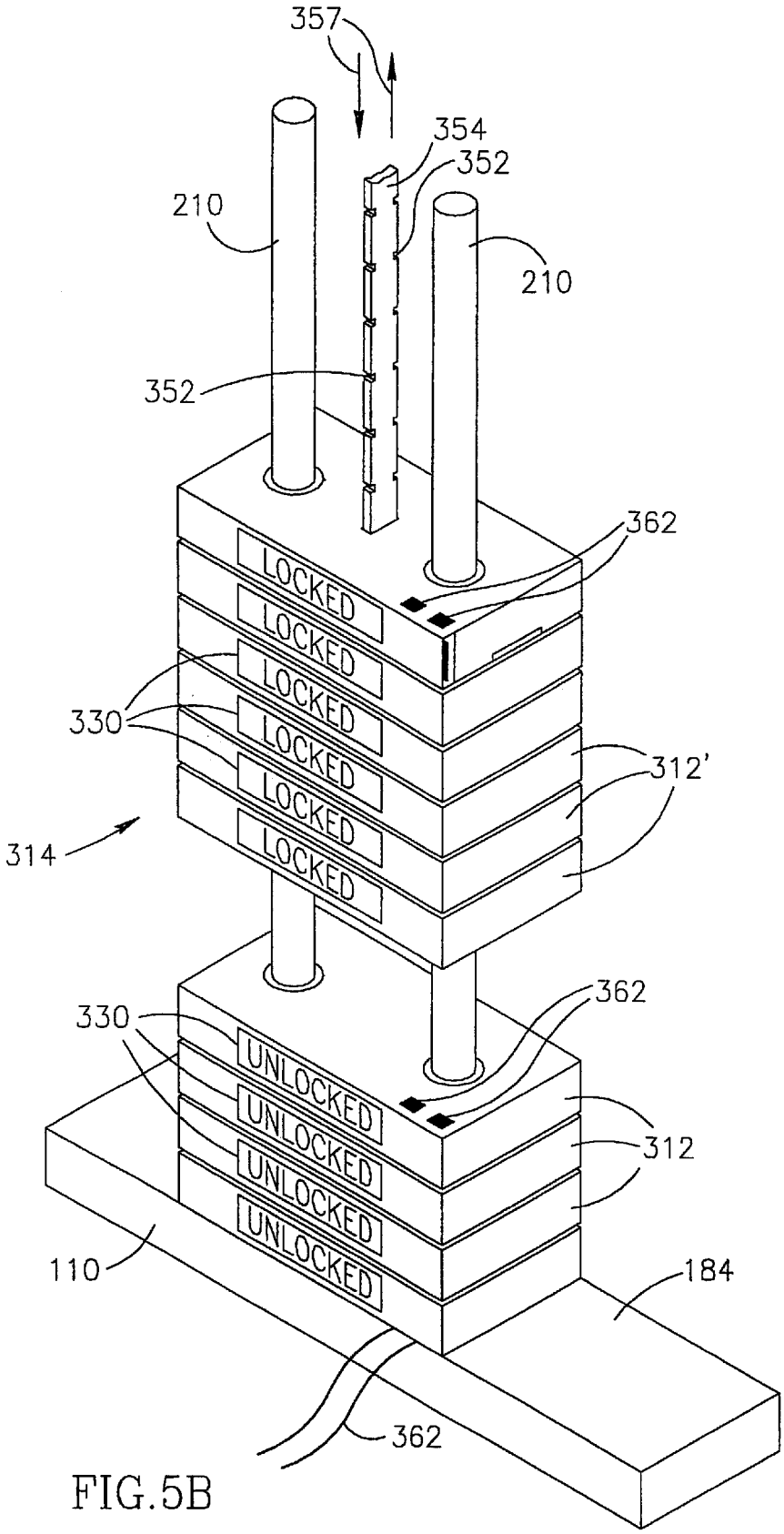
Figure 6A:
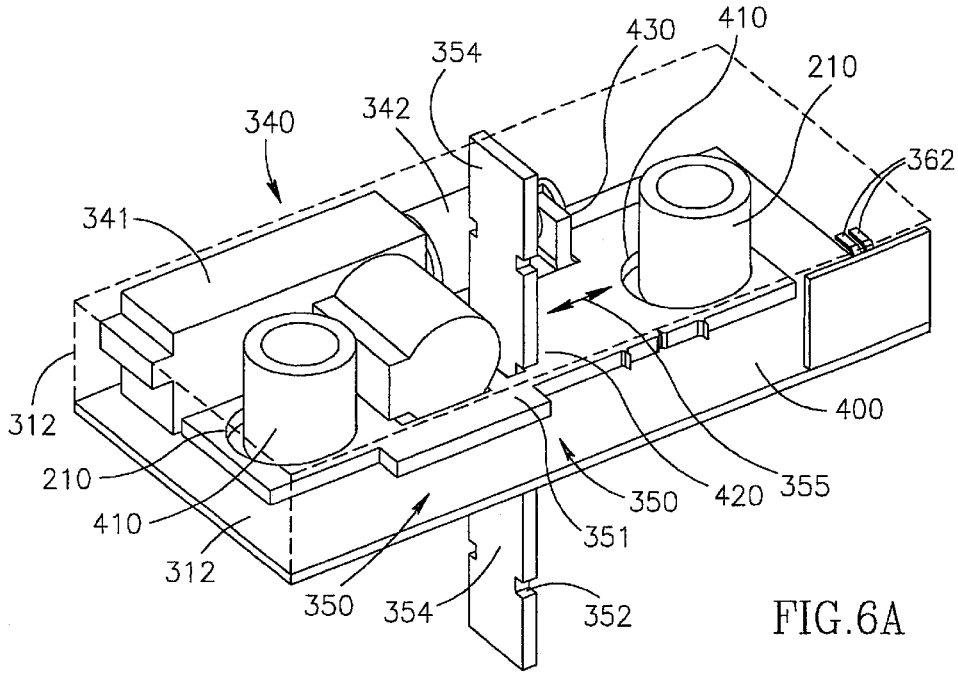
FIGS. 6A and 6B illustrate the selection device in the unlocked and locked position, respectively.
Figure 6B:
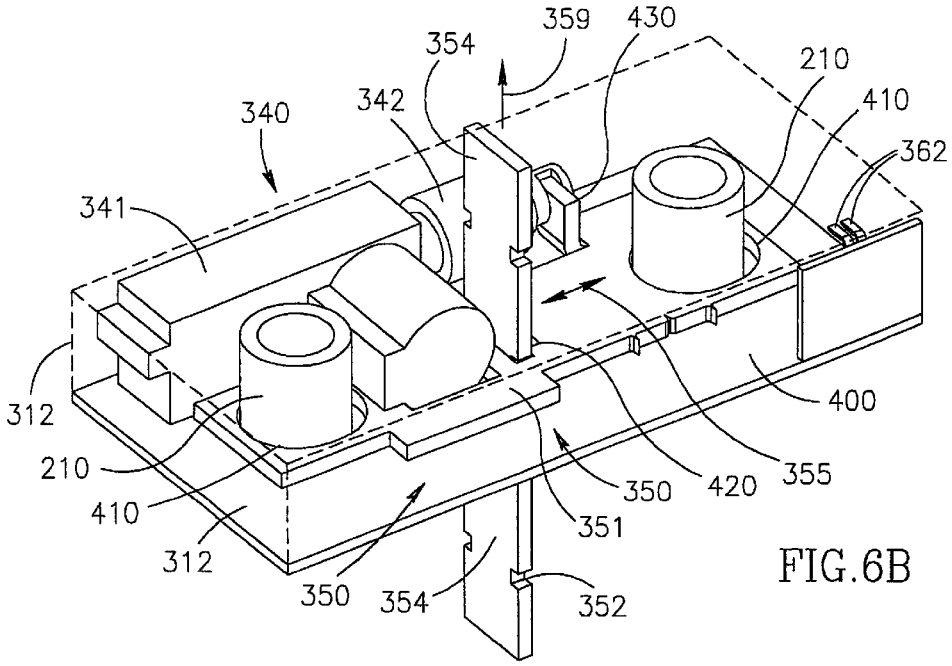
Figure 6C:
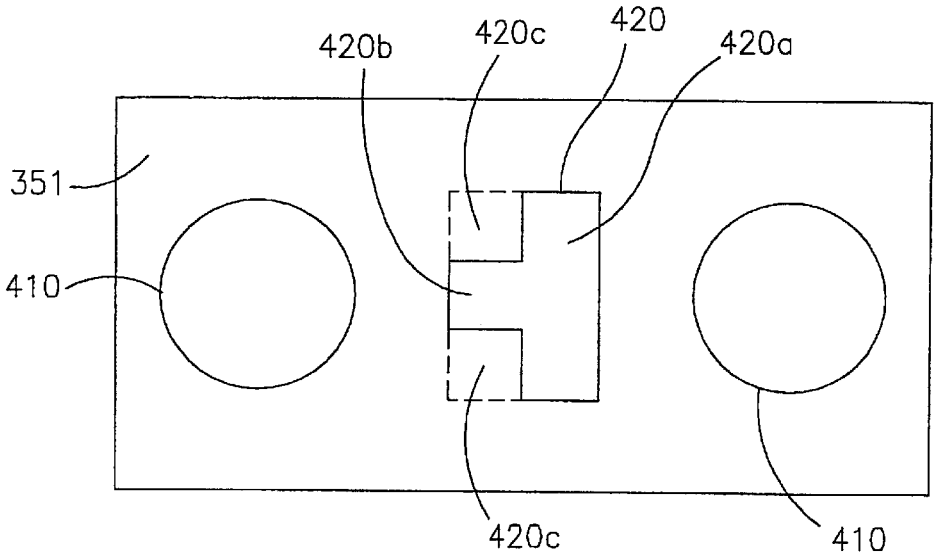
FIG. 6C is a planar illustration of a locking plate, in accordance with embodiments of the invention.

Selection device 330 comprises an operating device 340 connected to a locking element 350 which is more fully described in FIGS. 4, 5 and 6, to which reference is now also made. FIG. 4 is a schematic illustration of weight loading selection system 310. FIGS. 5A and 5B depict a preferred embodiment of the weight stack 314 of the present invention in a static non-used mode and exercise mode, respectively. FIGS. 6A and 6B illustrate the selection device 330 in the unlocked and locked position respectively, using exemplary operating devices 340 and locking elements 350. FIG. 6C is a plan view of plate 351. Similar items to those in previous figures have similar numerals and will not be described further.

Locking element 350 engages notches 352 In member 354. Notches 352 are spaced apart so that all locking elements 350 from each of weights 312 may simultaneously engage them and so connect to member 354 and be utilized as the "Exercise Load". Each selection device 330 preferably has a manual override switch 360 and is preferably supplied with electricity from an external source 361 through contacts 362. Only the contacts on the topmost weight 312 are shown for clarity, but there are contacts on the top and bottom surface of each weight 312 to ensure continuity of electric supply through weights 312. Electrical contacts 362 on the bottom surface of bottommost weight 312 of stack 314 also touch contacts 362 on base 184 when that weight is not being used to ensure good electrical contact.

Control device 320 comprises a processor 390 connected to a switch/input device 370 and to a display 380. Processor 390 is connected to selection device 330 via a wire or wireless link 332, as mentioned hereinabove.

Control device 320 controls selection device 330 comprising operating devices 340 and locking elements 350 for each weight 312, as shown. The locking elements 350 are in the form of a plate 351 which engages the corresponding notch 352 in member 354 via a T-shaped slot (FIGS. 6A–6C) when in the locked position as described more fully hereinbelow (FIGS. 6A–6C). The operating devices 340 are motors 341 (or similar) that provide translational motion to plate 350, as shown by the arrow 355, so that notch 352 is either engaged (locked) with member 354 or unlocked.

Referring particularly to FIGS. 5A and 5B, a preferred mode of operation of weight loading device 310 is illustrated. User 250 selects a desired exercising weight by inputting the weight via control device 320. This weight preferably appears on display device 380 as a readout. If user 250 selects a weight which comprises, for example, the aggregate of the top six weights, the top six weights will be selected and locked to the corresponding notches 352 on member 354 using their respective operating devices 340 and locking elements 350.

FIG. 5A illustrates the weight stack 314 in the rest (static) position 184, which is the position from which user 250 selects an exercise weight. In this position, the electricity supply 362 is connected to selection device 330 (schematically shown) via contacts 362 (of weight stack 314). User 250, for example, selects a weight corresponding to the aggregate of six weights 312 using input 370. Processor 390 then calculates the number of weights 312 required to be locked and sends the signal by wire (or wireless link) 332 (FIG. 4) to selection devices 330. The top six weights are then locked by selection devices 330 and the bottom four weights 312 are left unlocked. A signal is sent from processor 390 to the selection devices 330 of the top weights 312 required to be locked. This in turn activates operating devices 340 to lock the locking elements 350 of these six weights 312 to the notches 352 of member 354, thus achieving the desired exercising weight.

FIG. 5B illustrates weight stack 314 of FIG. 5A during exercising. The top six exercising weights 312' are locked to member 354 and are raised and lowered in the exercising motion as indicated by the arrows (357). Since the contacts 362 on the topmost weight 312' are disengaged from the contacts 362 (not shown) of the lowermost weight of these top six weights 312' (the exercising weights), the electrical supply Is disconnected from the locked top six weights 312' (the exercising weights) preventing unlocking of the top six weights 312' during exercise. Thus, exercising weights 312 are safely locked during exercise.

Specifically turning to FIGS. 6A–6C, the mode of locking the weights is shown. Plate 351 is contained within weight 312 (shown in outline) by a plate 400 attached to the underside of weight 312. Weight 312 contains the required inner profile to accommodate the structures which it must house. Plate 351 has two elliptical apertures 410 formed therethrough, through which members 210 pass. Plate 351 also has a T-shaped slot 420 in its center for locking onto notches 352 in member 354. Plate 351 is free to slide along plate 400 within the constraints of apertures 410 and T-shaped slot 420 engaging members 354 and 210, respectively, in the direction shown by arrow 355. Plate 351 is connected to motor 341 or the like via a tab 430 or similar so that the translational motion produced by motor 341 is imparted to plate 351.

As previously described, each notch 352 in member 354 corresponds to a plate 351 in one of the weights 312. FIG. 6A shows plate 351 in the unlocked position with member 354 freely able to slide within section 420*a* (FIG. 6C) of T-shaped slot 420. When weight 312 is required to be locked to member 354 in order to be part of the exercising weight (as shown in FIG. 6B), control device 320 actuates motor 341 to push plate 351 via actuator 342 so that part 420*b* of slot 420 engages notch 352. Thus, when an upward force is imparted to member 354 during exercising as shown by the vertical arrow (359), areas 420C of plate 351 engage the bottom-facing surface of notch 352, pulling weight 312 upwards as part of the exercise weight. It should be noted that motor 341 (via actuator 342) keeps the weight 312 locked whilst electricity supply 362 is disconnected, during exercising as described hereinabove.

Figure 7A:
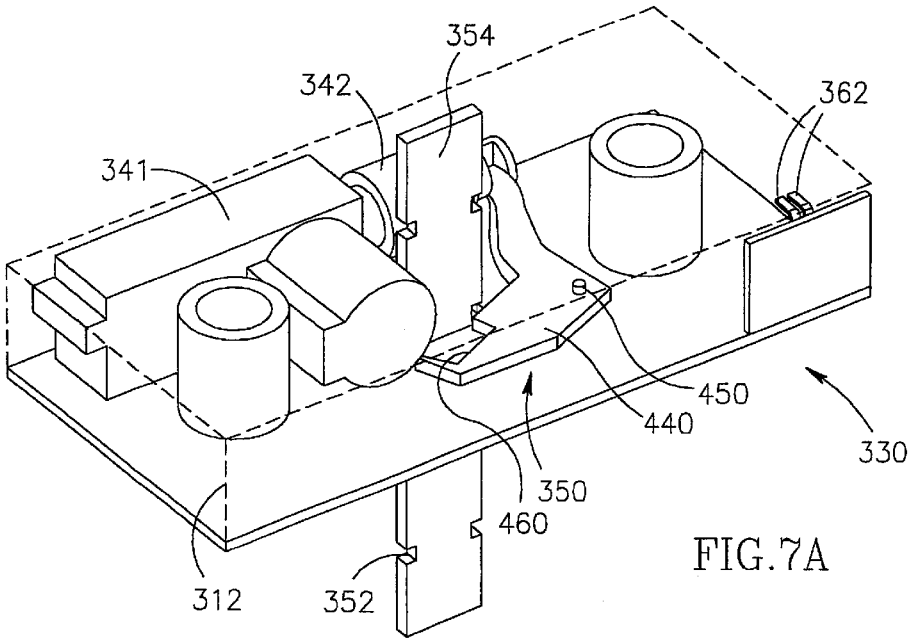
FIGS. 7A and 7B illustrate an alternative exemplary weight selection device, constructed and operative in accordance with a preferred embodiment of the present invention.
Figure 7B:
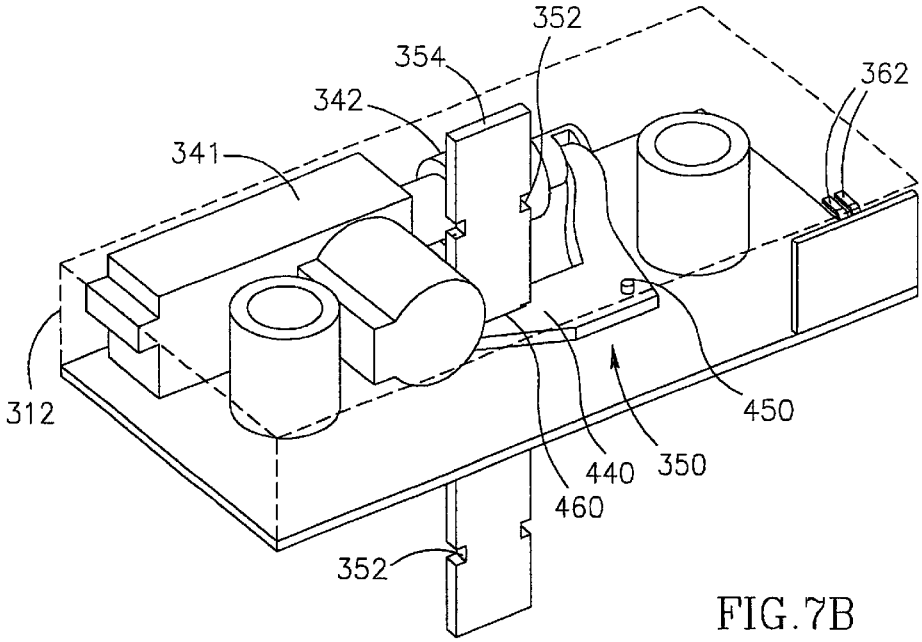

Reference is now made to FIGS. 7A and 7B which illustrate an alternative exemplary weight selection device 330. Similar items to those in previous figures carry similar reference numerals and will not be described further.

In order to lock weight 312 (shown in outline) to member 354, plate 440 contains a notch 460 which engages notch 352 in member 354. This is achieved as the linear action of motor 341 and actuator 342 is translated into a pivoting motion by pivot 450 to lock (FIG. 7B) and unlock (FIG. 7A) weight 312 to member 354.

It should be noted that many additional items may be added to the present invention. For example, a safety device may be incorporated to lock member 354 to the base 110. Member 354 thus becomes immovable if locked to base 110.

It should be noted that many variations of the present invention exist. For example selection devices 330 may be activated by manual switches 360. All of the weights 190 above a certain weight may be selected manually in order to lock them. Alternatively, only the lowest weight of the exercising weights (with the other weights resting upon the selected weight 190) may be locked. Likewise, the automatic selection may lock all the weights required to aggregate an exercising weight or just the lowest one. Control device 320 may be mounted anywhere on machine 300 or may be remote linked to selection device 330 to enable user 250 to select the exercise weight from any position. Further, the user may select the weight by selecting individual weights 312 to lock rather than a processor 390 deciphering a given exercise weight into a locking sequence.

It will be appreciated, by persons skilled in the art, that the present invention is not limited by what has been particularly shown and described hereinabove. Rather the scope of the invention is defined by the claims that follow:

What I claim is:

1. Apparatus for varying the load on an exercise machine, the apparatus comprising:

a stack of weight in slidable communication with at least one load-bearing member; and weight selection devices, each housed within a corresponding one of said weights, each of said weight selection devices comprising a motor and a locking device, said locking device housed within said corresponding weight and comprising a plate having a configured orifice, said configured orifice configured to engage said at least one load bearing member to selectably lock its corresponding weight to said at least one load-bearing member.

2. Apparatus according to claim 1 and further comprising a control unit remotely coupled to each of said weight selection devices, said control unit able to activate said locking device.

3. Apparatus according to claim 2, wherein said control unit comprises a processor connected to at least one switch device.

4. The apparatus of claim 2, wherein said control unit comprises a display.

5. The apparatus of claim 2, wherein said control unit comprises an input unit, which enables a user to select a desired weight load during exercise.

6. Apparatus according to claim 1, wherein said configured orifice is configured to slideably engage said at least one load bearing member.

7. Apparatus according to claim 1, wherein said configured orifice is configured to hingeably engage said at least one load bearing member.

8. The apparatus of claim 1, wherein each of said weights fiber comprises electrical contacts placed on the top and bottom surfaces of said weights able to provide an electrical path through said weights when said contacts are connected to an external electric supply.

9. A method for loading weights on an exercise machine, said exercise machine having a stack of weights in slidable communication with at least one load-bearing member, the method comprising:

determining by a control unit one or more selected weights to be engaged with said load-bearing member;

sending signals from said control unit to one or more motors, each within a corresponding one of said selected weights to activate a locking device, said locking device comprising a plate configured to engage the load bearing member and located within said corresponding weight; and locking one or more of said selected weights to said at least one load-bearing member.

10. The method according to claim 9, wherein locking one or more of said selected weights comprises locking at least lowermost of said selected weights.

11. The method according to claim 9, wherein locking one or more of said selected weights comprises locking each of said selected weights.

* * * * *